US007297023B2

(12) United States Patent
Chawgo

(10) Patent No.: US 7,297,023 B2
(45) Date of Patent: Nov. 20, 2007

(54) COAXIAL CABLE CONNECTOR WITH IMPROVED WEATHER SEAL

(75) Inventor: Shawn Chawgo, Liverpool, NY (US)

(73) Assignee: John Mezza Lingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/180,833

(22) Filed: Jul. 13, 2005

(65) Prior Publication Data

US 2007/0015406 A1 Jan. 18, 2007

(51) Int. Cl.
*H01R 9/05* (2006.01)

(52) U.S. Cl. ..... 439/578

(58) Field of Classification Search ..... 439/578, 439/584, 585

See application file for complete search history.

(56) References Cited

U.S. PATENT DOCUMENTS

| | | | | |
|---|---|---|---|---|
| 3,461,409 | A | 8/1969 | Miller | |
| 3,579,282 | A | 5/1971 | Couper | |
| 4,047,291 | A | 9/1977 | Spinner | |
| 5,401,173 | A | 3/1995 | Grandchamp et al. | |
| 5,576,675 | A | 11/1996 | Oldfield | |
| 5,662,336 | A | 9/1997 | Hayashi et al. | |
| 5,720,487 | A | 2/1998 | Kato | |
| 5,997,350 | A | 12/1999 | Burris et al. | |
| 6,530,807 | B2 | 3/2003 | Rodrigues et al. | |
| 6,650,209 | B2 | 11/2003 | Plummer et al. | |
| 6,716,061 | B2 | 4/2004 | Pitschi et al. | |
| 6,764,329 | B2 | 7/2004 | Noguchi et al. | |
| 6,767,247 | B2 | 7/2004 | Rodrigues et al. | |
| 6,773,303 | B1 | 8/2004 | Lin | |
| 6,783,394 | B1 * | 8/2004 | Holliday | 439/578 |
| 6,790,083 | B1 | 9/2004 | Chen | |
| 6,830,479 | B2 | 12/2004 | Holliday | |
| 6,848,939 | B2 | 2/2005 | Stirling | |
| 2005/0003706 | A1 | 1/2005 | Montena | |

* cited by examiner

*Primary Examiner*—Briggitte R. Hammond
(74) *Attorney, Agent, or Firm*—Christopher R. Pastel; Pastel Law Firm

(57) ABSTRACT

A coaxial cable connector includes an internal compression ring that provides a weather seal for a wide range of coaxial cable diameter sizes. The compression ring includes a flexing portion with a defined recessed section designed to flex outwardly when in contact with a wide diameter coaxial cable. With larger cables, the wall flexes more, while with smaller cables the wall flexes less, if at all, providing a seal in all cases.

14 Claims, 6 Drawing Sheets

COAXIAL CABLE CONNECTOR WITH IMPROVED WEATHER SEAL

FIELD OF THE INVENTION

This invention relates generally to a connector for terminating a coaxial cable. More specifically, the present invention relates to a coaxial cable connector with an internal compression ring structure that provides a weather seal for a wide range of coaxial cable diameter sizes.

BACKGROUND OF THE INVENTION

A number of connectors are available to terminate a coaxial cable so as to connect the cable to various electronic devices, such as switches, distribution boxes, manifolds, and electronic devices. In a typical coaxial cable network, a "drop" cable is used to carry the signal, which may include analog or digital TV signal, internet signal, security monitoring signal, etc., from the rigid coaxial cable near the road to the end user's home. The connector in many cases has to be installed outside of the end user's home so that the servicing and installation personnel can perform troubleshooting as well as connecting and disconnecting the signal without entering the end user's premises. The connector can thereby be exposed to weather elements, including periods of high moisture, temperature fluctuations, rain, snow, etc. The drop cable typically has an elongated copper or a copper clad steel center conductor, surrounded by a dielectric in turn surrounded by a conducting braid and/or foil which is used as a shield, which is in turn surrounded by a polymer-based insulating jacket, typically made of PVC or PE. The two most common sizes of this cable currently in use are series 59 and series 6.

The cables in each series vary greatly in size due to manufacturing tolerances, jacket type, and braid content. For example, cable types known as "Tri Shield" and "Quad Shield" which utilize second layers of foil and/or braided shield are increasingly used. This presents a challenge for connector manufacturers because the connectors must provide a watertight seal when installed on the cable. Since the size of the cables within each series varies, most manufacturers offer several connectors per series. This presents another problem because the connectors must be properly matched to the cable in order to ensure a proper seal. This situation is highly inconvenient for installation technicians, representing an undesirable additional cost due to the necessity of holding an extensive inventory of connectors which needs to be maintained, the increased possibility of erroneous mixing-up of connectors of different sizes, and the likelihood of installation mistakes.

Due to the above factors, the critical step of sealing the connection is often not achieved causing a non-hermetic seal and thereby a leak between the cable and the connector. The signal quality is then compromised at the subscriber's location due to parasite electrical pathways between the center conductor and the shielding formed by moisture, as well as the oxidation and corrosion of the internal connector components and of the center conductor, with consequent deterioration of the quality of the connection.

Both crimping and crimpless compression and sealing connectors were developed in an attempt to address the above issues. However, these connectors were not able to address both tight weather seal requirements and the suitability of one connector for use on cables of different sizes. The complexity of design and number of required parts makes some of these connectors impractical and expensive to manufacture. In addition, the procedures required to assemble these connectors in the field, often in inclement weather conditions, are complicated.

U.S. Pat. No. 6,767,247 shows a coaxial connector having a detachable locking sleeve attachably coupled to the connector's body. The locking sleeve is a cylindrical member formed of resilient material, which includes a flared rearward end through which a cable may be inserted. The locking sleeve is intended to be detachable and reattachable to the connector's body in a snap engagement and secures the cable within the connector's body.

U.S. Pat. No. 6,848,939 shows a coaxial cable connector with a deformable inner collar or bushing that permits the connector to be attached and sealed to cables of various sizes. The bushing is made of a deformable insulating material.

U.S. Patent application 2005/0003706 discloses a compression connector for a coaxial cable which radially compresses the cable in a tight frictional engagement.

SUMMARY OF THE INVENTION

Briefly stated, a coaxial cable connector includes an internal compression ring that provides a weather seal for a wide range of coaxial cable diameter sizes. The compression ring includes a flexing portion with a defined recessed section which is designed to flex outwardly when in contact with a wide diameter coaxial cable. With larger cables, the wall flexes more, while with smaller cables the wall flexes less, if at all, providing a seal in all cases.

According to an embodiment of the invention, a compression connector for mounting upon an end of a coaxial cable, where the cable has a center conductor, a dielectric insulator surrounding the center conductor, a conductive shield surrounding the dielectric insulator, and an outer protective insulating jacket, includes a main body defining an internal cavity; a compression ring connected to one end of the main body; the compression ring having an annular recess in an outer circumference thereof forming a flexible wall area of the compression ring; and the annular recess forming a flexing space between the flexible wall area of the compression ring and the main body.

According to an embodiment of the invention, a compression connector for mounting upon an end of a coaxial cable, the cable having a center conductor, a dielectric insulator surrounding the center conductor, a conductive shield surrounding the dielectric insulator, and an outer protective insulating jacket, includes a main body defining an internal cavity; a compression ring connected to one end of the main body; the compression ring including flexing means for flexing outwardly towards the main body when a coaxial cable is inserted into the connector and the compression ring is fully inserted into the main body.

According to an embodiment of the invention, a method of manufacturing a compression connector for a coaxial cable includes the steps of making a main body; making a threaded nut body connected to the main body at a first end thereof; making a compression ring connected to the main body at a second end thereof; and forming an annular groove in an outer portion of the compression ring, thereby forming a flexible wall area in the compression ring.

DETAILED DESCRIPTION OF THE PREFERRED EMBODIMENT

Figure 1:
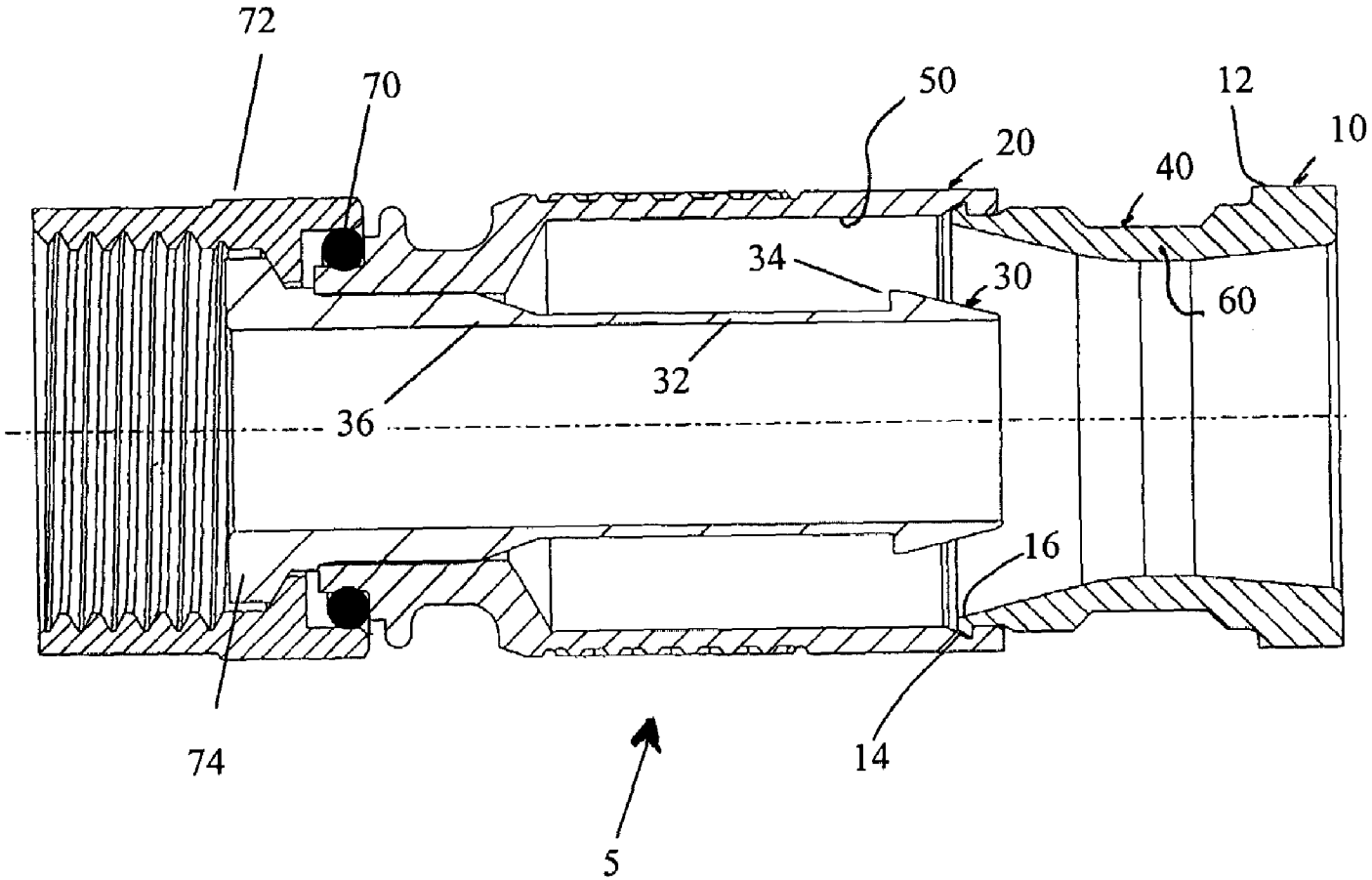
FIG. 1 shows a longitudinal section of a compression connector in an uncompressed state according to an embodiment of the invention.
Figure 3:
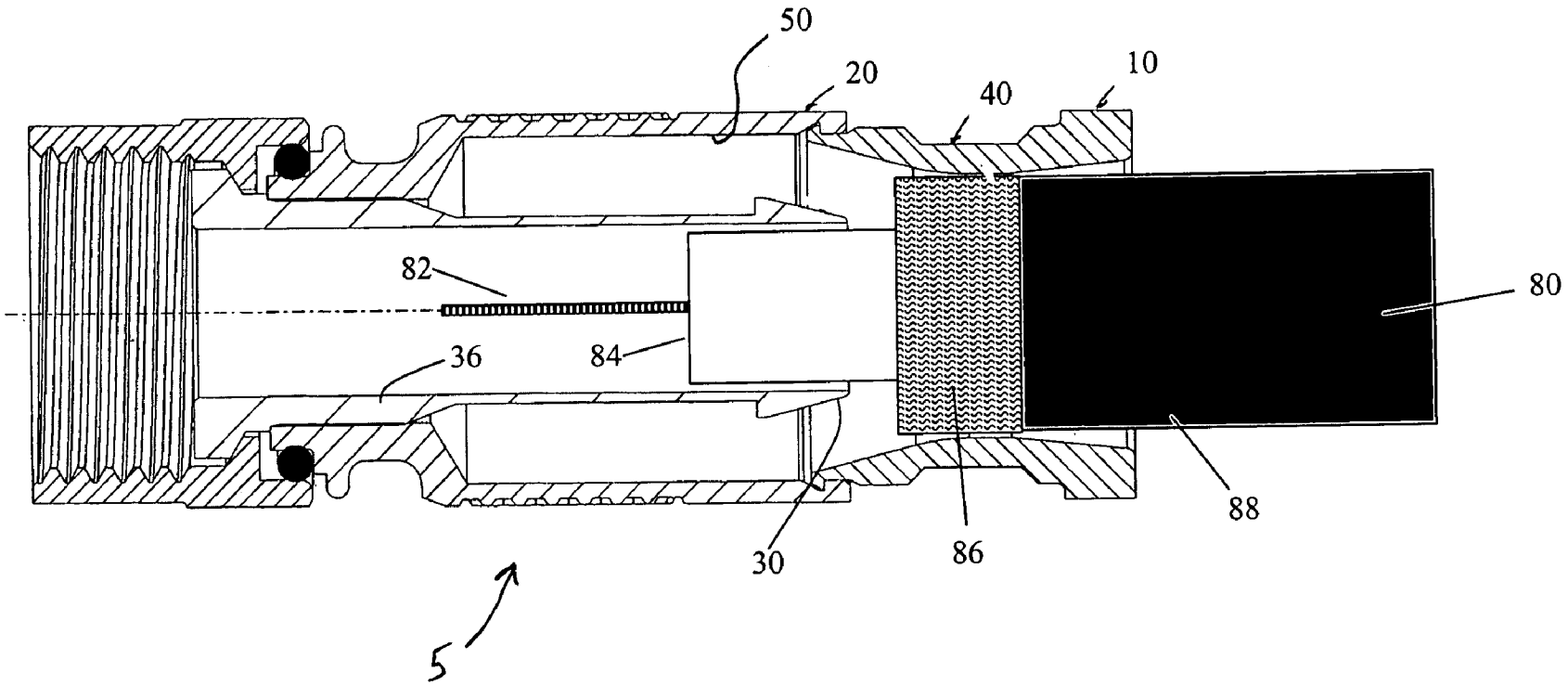
FIG. 3 shows the longitudinal section of FIG. 1 with the compression ring attached and a coaxial cable being inserted into the connector.

Referring to FIG. 1, a connector 5 according to an embodiment of the present invention is shown prior to the insertion of a coaxial cable 80 (FIG. 3). Connector 5 includes a main body 20, a compression ring 10 connected to main body 20, a threaded nut 72 for interconnecting connector 20 to a mating connector or port (not shown), an O-ring or gasket 70 which seals the connection between nut 72 and main body 20, and an internal post 36. Internal post 36, nut 72, and O-ring 70 are of conventional construction for use in this type of coaxial cable connector. O-ring 70 is preferably made of easily compressible sealing material, such as rubber, plastic, or similar gasket material. Internal post 36 preferably includes an integrally formed flange 74 and a stem 32. Stem 32 is preferably terminated with a tapered end 30 which preferably also includes a barb 34. The diameter of barb 34 is enlarged compared to the diameter of stem 32. Internal post 36 preferably has a bore of a diameter suitable to receive a dielectric insulator 84 of coaxial cable 80. Main body 20 provides an enclosure for receiving coaxial cable 80 as well as for mounting nut 72, internal post 36, O-ring 70, and compression ring 10. Nut 72 is preferably rotatably mounted on main body 20 and on internal post flange 74. Main body 20 also includes a cylindrical wall 50 concentric to internal post 36, defining an annular channel between them which is dimensioned to receive a jacket 88 and a shield 86 of coaxial cable 80.

Compression ring 10 is preferably initially mounted on and engaged with main body 20 preferably utilizing a circumferential tooth 16 and a groove 14 connection, with tooth 16 provided on compression ring 10 and groove 14 provided on main body 20. Compression ring 10 is preferably slidably attached to connector main body 20 and is capable of being moved further into main body 20 when driven forward by a compression tool (not shown) to disengage circumferential tooth 16 and groove 14 connection and move into main body 20 until an outer portion 12 of compression ring 10 contacts main body 20, as illustrated in FIG. 2.

Figure 2:
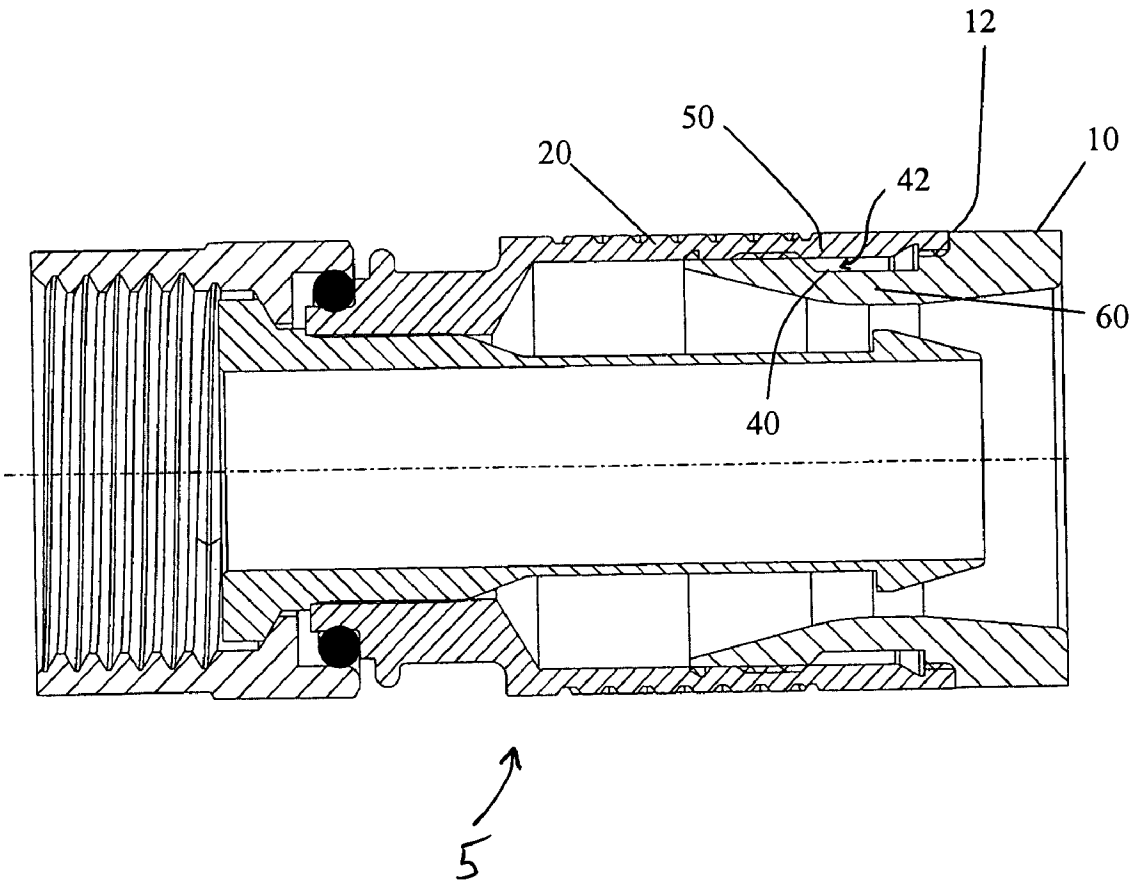
FIG. 2 shows the longitudinal section of FIG. 1 with a compression ring in a final compressed state.

Referring to FIG. 2, connector 5 is shown in its fully assembled final position, but with coaxial cable 80 (FIG. 3) not shown. Compression ring 10 is in its compressed position. As compression ring 10 is compressed, the forward movement disengages circumferential tooth 16 from groove 14 and then moves compression ring 10 into main body 20 until outer portion 12 of compression ring 10 contacts main body 20. A recessed section 40 of compression ring 10 defines a flexing space 42 between a recessed area wall 60 of compression ring 10 and cylindrical inner wall 50 of main body 20. Flexing space 42 is the area within which recess wall 60 moves when a large diameter cable is inserted into connector 5.

Referring to FIG. 3, the initial phase of coaxial cable 80 and connector 5 assembly is shown. Coaxial cable 80, which is shown partially inserted into the connector 5, includes an elongated center conductor 82, formed of electrically conductive material, dielectric insulator 84 formed of insulating material such as suitable plastic, surrounding the center conductor, metallic shield 86 in the form of a braid or a foil or other suitable conductive material which surrounds the dielectric insulator, and an insulating jacket 88 covering metallic shield 86. Coaxial cable 80 is shown with the end of cable 80 already prepped in the specified (conventional) manner for termination, which preferably includes stripping off jacket 88, partially removing dielectric insulator 84, folding back or partially or completely removing shield 86, and exposing center conductor 82, dielectric insulator 84, and shield 86 in the usual manner. Prepped end of coaxial cable 80 is axially inserted into compression ring 10 and into main body 20 of connector 5, with dielectric insulator 84 and center conductor 82 entering internal post 36 bore whereas tapered end 30 slides beneath shield 86 and jacket 88 of coaxial cable 80. Barb 34 on internal post 36 resists the removal of coaxial cable 80 from connector 5.

Figure 4:
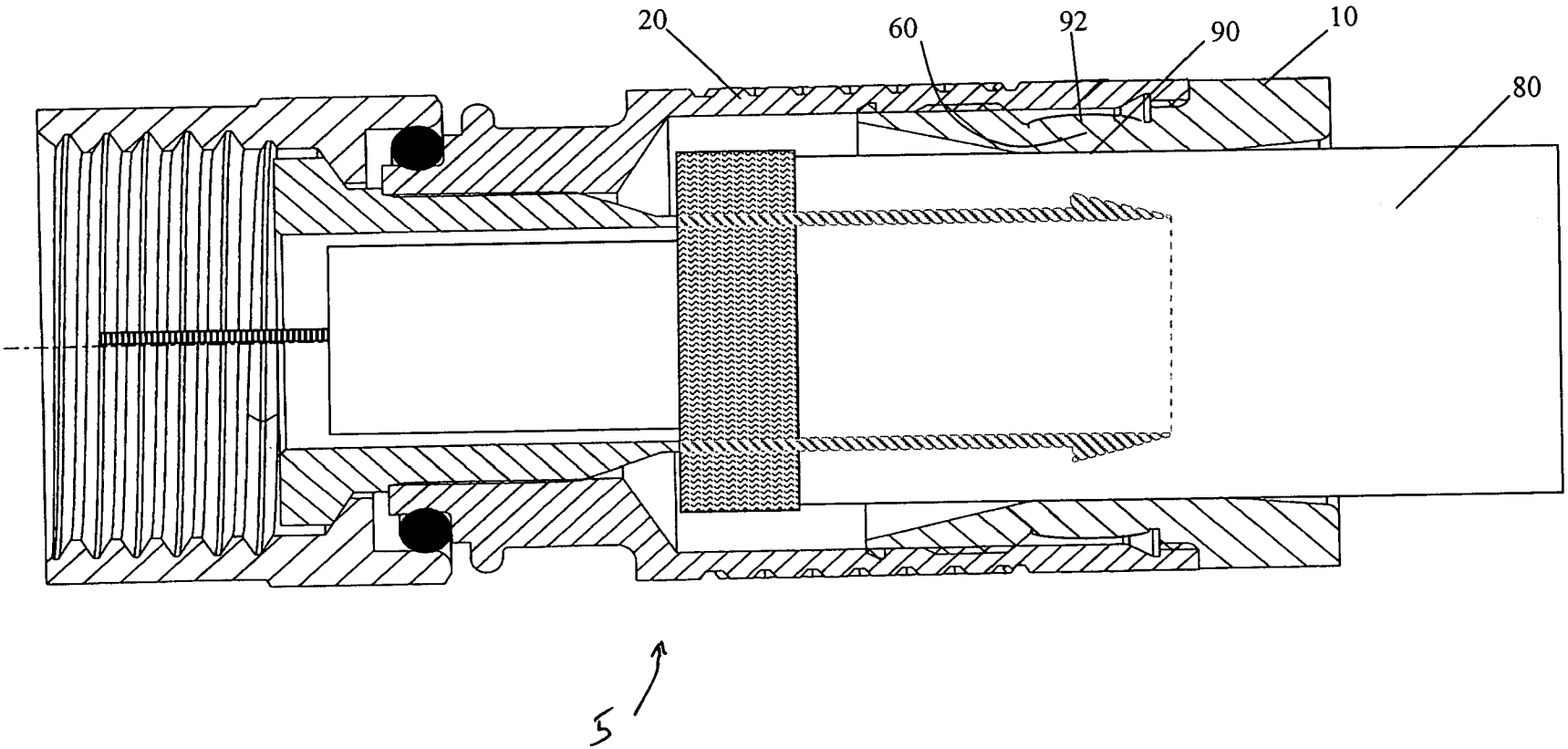
FIGS. 4 and 5 show the longitudinal sections of the fully assembled connector in a final compressed state with the coaxial cable fully inserted in the connector and with the compression ring in the final fully inserted position.
Figure 5:
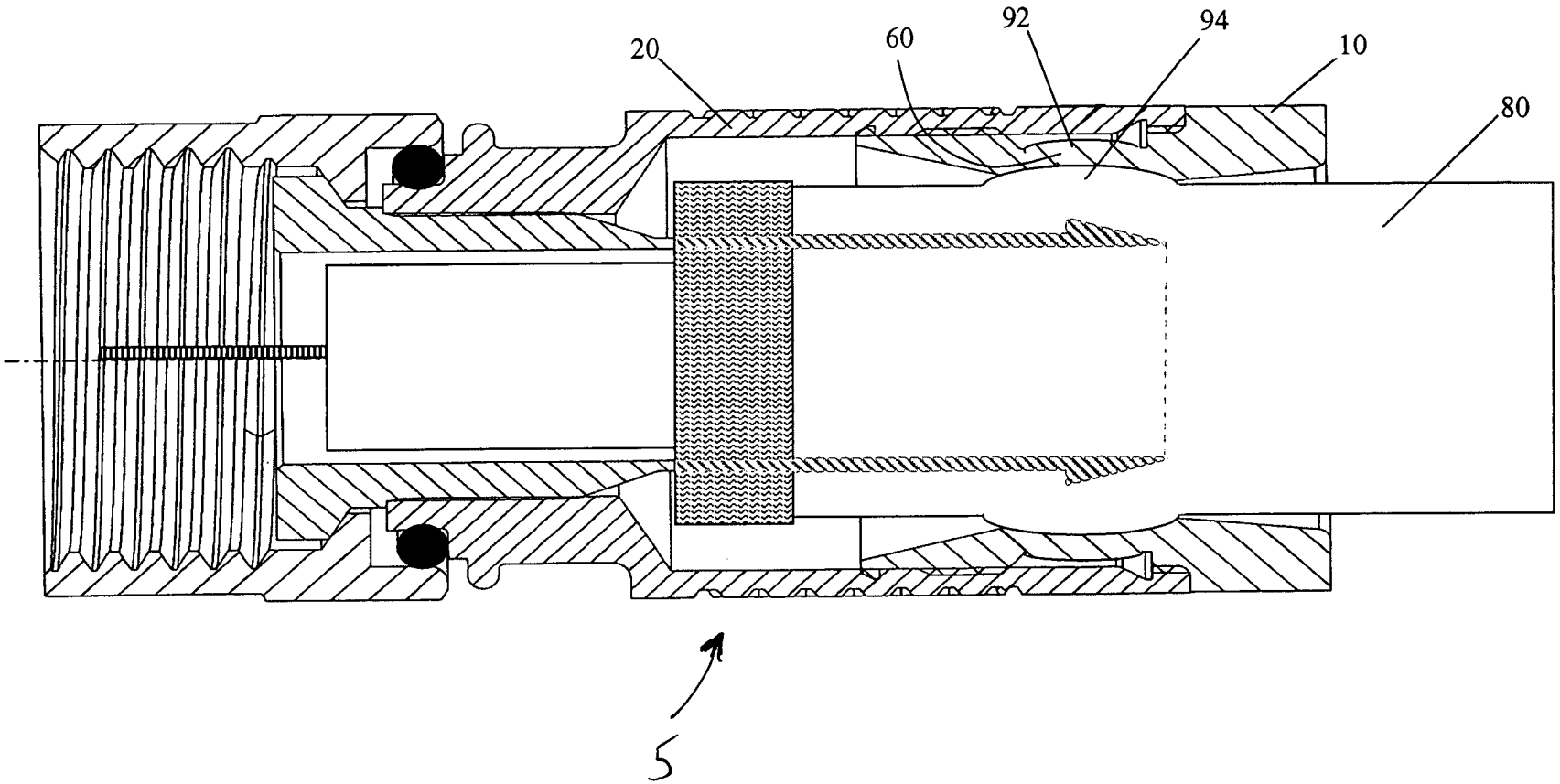

Referring to FIGS. 4 and 5, connector 5 is shown in its fully assembled compressed position, with cable 80 inserted. The preferred arrangement of connector 5 and coaxial cable 80 is shown after cable 80 has been fully inserted into connector 5 with central conductor 82 preferably extending into nut 72 for further coupling to a mating connector or port (not shown). Coaxial cable 80 is engaged by internal post stem 32 tapered end 30 and by barb 34 of internal post 36. After cable 80 is fully inserted into connector 5, compression ring 10 is driven forward by a tool (not shown) until outer portion 12 contacts main body 20 of connector 5. Coaxial cable 80 contacts compression ring 10 in a protruding area 90 and exerts an outward pressure onto compression ring 10 wall in this area. The outward flexing of recessed area wall 60 of compression ring 10 is shown with reference numeral 92.

As further illustrated by FIGS. 4 and 5, shield 86 and jacket 88 of coaxial cable 80 are compressed between internal post 36 and protruding area 90 of compression ring 10, allowing recessed area wall 60 of compression ring 10 to flex outwardly into flexing space 42 (FIG. 2). With a larger diameter cable 80, recessed area wall 60 flexes more and with smaller diameter cable 80 recessed area wall 60 flexes less, if at all, providing a weather seal in both cases. If recessed area wall 60 were not allowed to flex, compression ring 10 would not seal on a large range of coaxial cables 80. Once cable 80 is inserted and connector 5 is in final compressed state, the seal is ensured by compression of cable 80 by compression ring 10.

With reference to FIG. 5, the mechanism of the formation of the seal between coaxial cable 80 and compression ring 10 is shown in further detail. The engagement of tapered end 30 and barb 34 of internal post stem 32 with coaxial cable 80 can result in an additional increase of the local diameter of cable 80 and formation of a bulge 94 on coaxial cable 80. Because recessed area 40 of compression ring 10 is situated opposite bulge 94, recessed area wall 60 of compression ring 10 is able to flex outwardly. Bulge 94 improves the seal contact between coaxial cable 80 and compression ring 10, resulting in a better seal.

Figure 7:
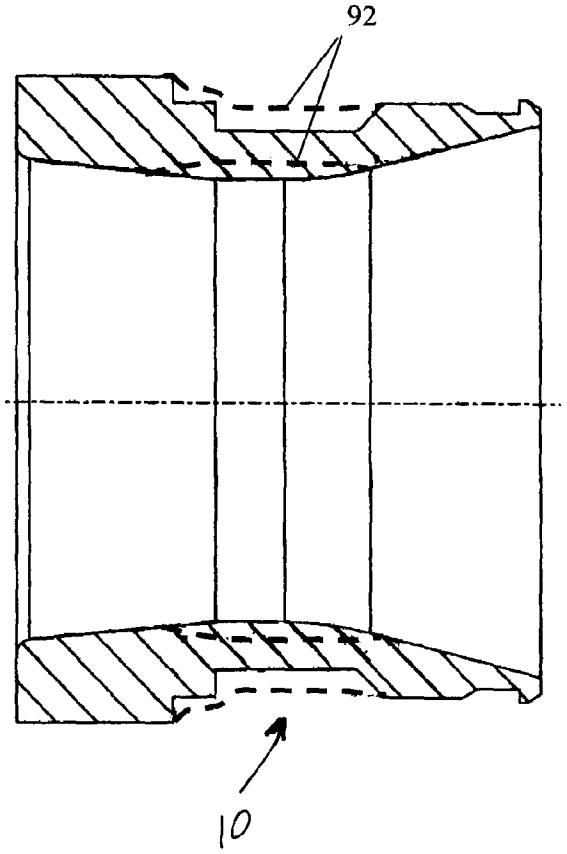
FIG. 7 shows a sectional view showing the flexing of the compression ring according to an embodiment of the invention.
Figure 6:
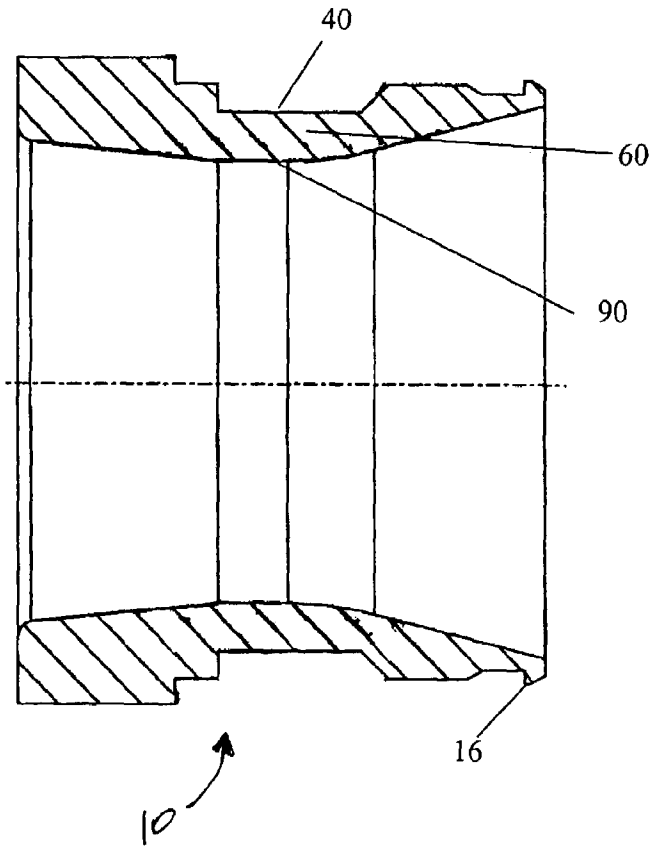
FIG. 6 shows a sectional view of the compression ring according to an embodiment of the invention.

Referring to FIGS. 1, 6, and 7, compression ring 10 is a hollow, substantially cylindrical member which has defined recessed section 40. Recessed section 40 is essentially a large groove on the outside of the cylindrical member located roughly in the middle of the axial dimension of ring 10. Opposite recessed section 40 is protruding area 90 on the inside of the cylinder. Low thickness recess wall 60 is formed between recessed section 40 and protruding area 90 substantially in the middle of compression ring 10. Outer portion 12 of compression ring 10 preferably has a larger diameter than an inner diameter of cylindrical inner wall 50 of main body 20. Compression ring 10 is sized so as to be suitable for slidable insertion into main body 20. Recess wall 60 of compression ring 10 is weakened due to its lessened thickness and is able to flex outwardly to a flexed position as indicated by dashed lines 92.

As it is clear from the above description and accompanying drawings, compression ring 10 provides a weather seal for a wide range of coaxial cable 80 diameter sizes and types. Compression ring 10 has defined recessed section 40 which is designed to flex outwardly. Flexing space 42 between recessed area 40 of compression ring 10 and main body 20 is able to accept the flexing of recessed area wall 60 of compression ring 10. With larger diameter cables 80, recessed area wall 60 flexes more, and with smaller cables 80 recessed area wall flexes less, if at all, providing a reliable and tight weather seal in both cases. If recessed area wall didn't flex, compression ring would not seal over a large range of cable 80 sizes and diameters, but would be capable of only sealing cables 80 with sizes exactly fitting a given size of compression ring 10.

While the present invention has been particularly shown and described with reference to the preferred mode as illustrated in the description and drawings, it will be understood by one skilled in the art that various changes in detail may be effected therein without departing from the spirit and scope of the present invention as defined by the claims.

I claim:

1. A compression connector connectable to one of a plurality of coaxial cables having different sized outer diameters, each cable having a center conductor, a dielectric insulator surrounding the center conductor, a conductive shield surrounding the dielectric insulator, and an outer protective insulating jacket, the compression connector comprising:

a main body defining an internal cavity;

a compression ring connected to one end of the main body;

the compression ring having an annular recess in an outer circumference thereof defining a flexible wall area of the compression ring; and the annular recess forming a flexing space between the flexible wall area of the compression ring and the main body;

wherein the flexible wall area has a flexing range between a first position corresponding to a smallest outer diameter of the plurality of coaxial cables and a second position corresponding to a largest outer diameter of the plurality of coaxial cables;

the flexing range of the flexible wall area effective for permitting any one of the plurality of coaxial cables having different sized outer diameters;

such that when the coaxial cable is fully secured in the compression connector, the flexible wall area is within the flexing range.

2. A connector according to claim 1 further comprising an internal post mounted inside the main body, the internal post having a cross-section such that the internal post is effective for passing between the dielectric insulator and the outer protective insulating jacket of the coaxial cable inserted into the main body through the compression ring.

3. A connector according to claim 1, wherein the flexible wall area flexes outwardly into the flexing space when the compression ring is inserted into the main body after a coaxial cable is inserted into the connector.

4. A connector according to claim 1 wherein the compression ring has a first inner diameter at a first end, the first end being the end through which an inserted coaxial cable passes when inserted into the connector; and the flexible wall area of the compression ring has a second inner diameter, smaller than the first inner diameter.

5. A connector according to claim 1 wherein the compression ring is made of metal, metallic alloy, composite, or plastic.

6. A compression connector connectable to one of a plurality of coaxial cables having different sized outer diameters, each cable having a center conductor, a dielectric insulator surrounding the center conductor, a conductive shield surrounding the dielectric insulator, and an outer protective insulating jacket, the compression connector comprising:

a main body defining an internal cavity;

a compression ring connected to one end of the main body;

the compression ring including flexing means for flexing outwardly towards the main body when a coaxial cable is inserted into the connector and the compression ring is fully inserted into the main body, wherein the flexing means includes a flexing range between a first position corresponding to a smallest outer diameter of the plurality of coaxial cables and a second position corresponding to a largest outer diameter of the plurality of coaxial cables;

the flexing range of the flexing means effective for permitting any one of the plurality of coaxial cables having different sized outer diameters;

such that when the coaxial cable is fully secured in the compression connector, at least a portion of the flexing means is within the flexing range.

7. A connector according to claim 6 further comprising an internal post mounted inside the main body, the internal post having a cross-section such that the internal post is effective for passing between the dielectric insulator and the outer protective insulating jacket of the coaxial cable inserted into the main body through the compression ring.

8. A connector according to claim 6 wherein the flexing means is made of metal, metallic alloy, composite, or plastic.

9. A compression connector according to claim 6, wherein the flexing means includes an annular recess in an outer circumference thereof forming a flexible wall area of the compression ring; and the annular recess forms a flexing space between the flexible wall area of the compression ring and the main body.

10. A connector according to claim 9 wherein the compression ring has a first inner diameter at a first end, the first end being the end through which the inserted coaxial cable passes when inserted into the connector; and the flexible wall area of the compression ring has a second inner diameter, smaller than the first inner diameter.

11. A method of manufacturing a compression connector connectable to one of a plurality of coaxial cables having different sized outer diameters, comprising the steps of:

making a main body;

making a threaded nut body connected to the main body at a first end thereof;

making a compression ring connected to the main body at a second end thereof; and forming an annular groove in an outer portion of the compression ring, thereby defining a flexible wall area in the compression ring, wherein the flexible wall area has a flexing range between a first position corresponding to a smallest outer diameter of the plurality of coaxial cables and a second position corresponding to a largest outer diameter of the plurality of coaxial cables; and the flexing range of the flexible wall area is effective for permitting any one of the plurality of coaxial cables having different sized outer diameters;

such that when the coaxial cable is fully secured in the compression connector, the flexible wall area is within the flexing range.

12. A method according to claim 11, wherein the flexible wall area has an inner diameter greater than or equal to an outer diameter of the coaxial cable.

13. A method according to claim 12, wherein the compression ring has a first inner diameter at an end through which an inserted coaxial cable passes when inserted into the connector; and the flexible wall area of the compression ring has a second inner diameter, smaller than the first inner diameter.

14. A connector according to claim 13 further comprising the step of mounting an internal post inside the main body, the internal post having a cross-section such that the internal post is effective for passing between the dielectric insulator and the outer protective insulating jacket of the coaxial cable inserted into the main body through the compression ring.

* * * * *